US005707305A

United States Patent [19]

Goeders et al.

[11] Patent Number: 5,707,305

[45] Date of Patent: Jan. 13, 1998

[54] PORTABLE PITCHING MOUND

[75] Inventors: John J. Goeders, Altoona, Iowa; Jon J. Goeders, Kirkwood, Mo.

[73] Assignee: True Pitch, Inc., Altoona, Iowa

[21] Appl. No.: 742,590

[22] Filed: Oct. 28, 1996

[51] Int. Cl.[6] ..... A63B 71/00

[52] U.S. Cl. ..... 473/497

[58] Field of Search ..... 473/497

[56] References Cited

U.S. PATENT DOCUMENTS

| | | | |
|---|---|---|---|
| D. 214,743 | 7/1969 | Goeders . | |
| 3,479,028 | 11/1969 | Goeders . | |
| 3,837,646 | 9/1974 | Goeders . | |
| 4,306,718 | 12/1981 | Goeders . | |
| 4,561,653 | 12/1985 | Wright | 473/497 |
| 4,749,223 | 6/1988 | Goeders | 473/497 |
| 4,925,186 | 5/1990 | Stevenson | 473/497 |
| 5,058,889 | 10/1991 | Burton | 473/497 |
| 5,213,323 | 5/1993 | Novinsky | 473/497 |
| 5,467,977 | 11/1995 | Beck . | |

*Primary Examiner*—Theatrice Brown

*Attorney, Agent, or Firm*—Zarley, McKee, Thomte, Voorhees, & Sease

[57] ABSTRACT

A portable pitching mound includes a generally convex body member having detachably securable front and rear portions. The rear portion has top and bottom surfaces with a peripheral edge extending therebetween. The front portion is detachably secured to the rear portion along a portion of the peripheral edge. The front portion has a top surface that includes a hollow for receiving a dense soil mixture to make a realistic, yet portable pitching mound.

12 Claims, 4 Drawing Sheets

PORTABLE PITCHING MOUND

BACKGROUND OF THE INVENTION

The present invention relates to the field of devices for baseball. More particularly, this invention relates to an indoor/outdoor baseball pitching mound that is realistic yet portable, and disassembles into components of more manageable size to facilitate transport and storage.

Portable pitching mounds are known in the art. For example, U.S. Pat. No. 4,306,718 discloses a portable pitching mound which has a pitching rubber on top of a unitary arcuate shell. A layer of artificial turf extends forward from the pitching rubber to the front edge of the mound. The pitcher must begin a regulation pitch by placing at least one foot on or against the rubber. The pitcher then winds up, throws, and generally strides forward toward home plate to deliver the pitch. Thus, the mound and the artificial turf thereon support the pitcher during the throwing or pitching motion (windup, throw, and follow through).

Although artificial turf is often used on indoor and outdoor baseball diamonds, conventional outdoor diamonds still rely on stationary built-up dirt pitching mounds. Those mounds comprise a clay-based soil mixture including dirt, sand, or the like. This clay-based soil mixture will hereinafter be referred to simply as clay or dirt. The clay is advantageous for several reasons. The worn spots in the clay can easily be filled in by the grounds crew. The clay provides firm footing for the pitcher and allows the pitcher to wear cleats or spikes to improve footing under a variety of field and weather conditions. There is a need for a portable pitching mound that is more realistic in appearance and function.

Artificial turf is lightweight, which enhances the portability of the pitching mound disclosed in U.S. Pat. No. 4,306,718 patent. However, one disadvantage of using such a lightweight material to provide footing for the pitcher is that extra strips of artificial turf or separate anchoring means may be needed to suitably secure the portable pitching mound to the ground or other supporting surface. Some anchor means may damage the supporting surface, especially in indoor applications.

Therefore, a primary object of the present invention is the provision of an improved portable pitching mound.

A further object of this invention is the provision of a self-anchoring portable pitching mound.

A further object of this invention is the provision of a portable pitching mound comprising two major portions detachably secured to each other, with one of the portions having an aperture with a clay-receiving bin positioned therein.

A further object of this invention is the provision of a portable pitching mound which has a front portion with an aperture therein for holding a bin of clay.

A further object of this invention is the provision of a portable pitching mound that has front and rear portions joined along a transverse seam.

A further object of this invention is the provision of a portable pitching mound wherein a clay-receiving bin has slots therein for receiving the forks of a lifting device to facilitate the transportation of the bin.

These and other objects will be apparent to one skilled in the art from the drawings and the description which follows.

SUMMARY OF THE INVENTION

The present invention relates to a portable pitching mound. The portable pitching mound comprises a generally convex body member which includes front and rear portions secured together along a seam. The rear portion has top and bottom surfaces and a peripheral edge extending therebetween. The front portion detachably fastens to the rear portion along a portion of the peripheral edge of the rear portion. The front portion has a top surface with a hollow therein for receiving a dense soil mixture, such as clay or the like.

The portable pitching mound also includes a bin removably disposed in the aperture of the front portion. The bin includes at least one horizontally elongated cavity therein for receiving a lifting member, such as the forks of a forklift. The aperture and the bin disposed therein can each have opposing sides which diverge from each other in a forward direction.

The hollow and the front portion where the bin is disposed allows a dense soil mixture to be packed thereinto so as to make a realistic yet portable pitching mound.

Various procedures for installing and removing the portable pitching mound are also disclosed herein.

DETAILED DESCRIPTION OF THE PREFERRED EMBODIMENT

Figure 1:
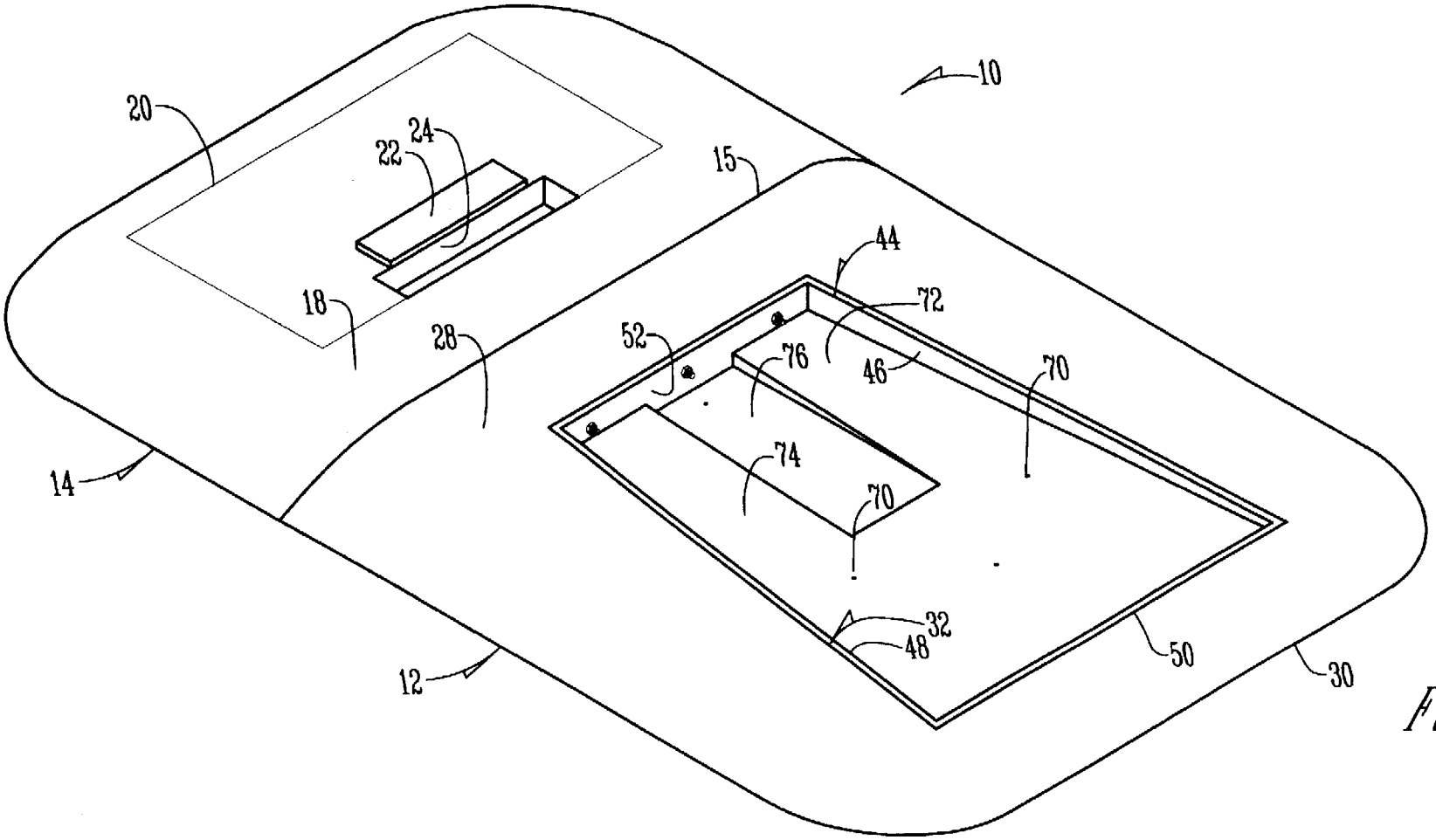
FIG. 1 is a perspective view of the portable pitching mound of the present invention.

In the drawings and the description which follows, the portable pitching mound of this invention is generally designated by the reference numeral 10. The portable pitching mound is a generally oblong convex shell-like structure which includes a front portion 12 and a rear portion 14 joined along a generally transverse seam 15 as shown in FIG. 1.

The rear portion 14 has a bottom surface 16 (see FIG. 2) and a top surface 18 has a centrally located level area 20 on which a pitcher may stand. More particularly, the pitcher must contact the raised pitching rubber 22 disposed on the top surface 18 of the pitching mound 10 to begin each pitch. Some pitchers choose to stand on top of the pitching rubber 22. Pitchers utilizing this stance generally place the toe or another portion of their trailing leg into the area just in front of the pitching rubber 22 during the pitch. Therefore, a toe-receiving depression or bin 24 is provided adjacent the front edge of the pitching rubber 22. The toe-receiving bin 24 extends transversely across the top surface 18 and alongside the pitching rubber 22 as shown in FIG. 1.

Figure 4:
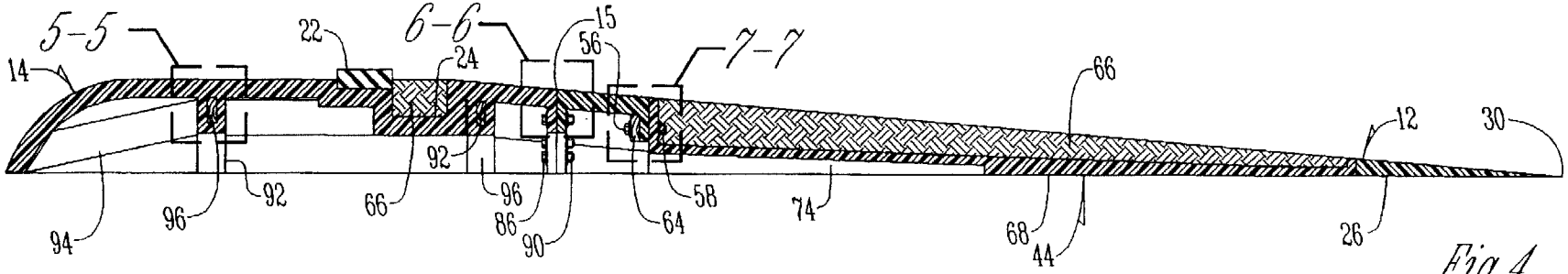
FIG. 4 is a longitudinal cross-sectional view of the pitching mound of this invention taken along line 4—4 in FIG. 3.

The front portion 12 of the pitching mound 10 includes a bottom surface 26 (FIG. 4) and a top surface 28 (FIG. 1). As best seen in FIGS. 1 and 4, the rear portion 14 forward of the toe-receiving bin 24 and the top surface 28 both taper downwardly toward the front edge 30 as prescribed by the regulations of the game. A forward slope of approximately 1"/12" is preferred. The slope and curvature of the sides and back of the pitching mound 10 are also controlled by the regulations of the game. The preferred slope of the back of the mound 10 is approximately 10"/14".

The top surface 28 of the front portion 12 has an aperture 32 therein which has a generally rectangular cross-section and is defined by a plurality of interior walls 36, 38 and 40 that extend generally downward from the top surface 28. Due to the forward slope of the top surface 28, the opposing sides 38 and 40 of the aperture 32 taper smaller in height as they approach the front of the pitching mound 10. A plurality of holes 42 extend horizontally through the back wall 36.

Figure 7:
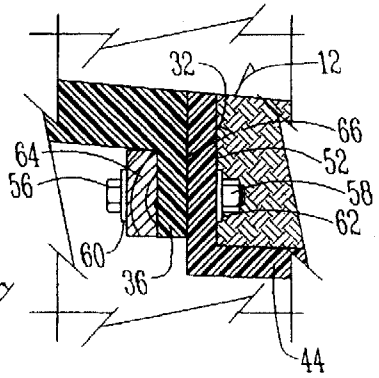
FIG. 7 is an enlarged cross-sectional view taken of the area of 7—7 in FIG. 4.

A bin 44 for receiving clay or other suitable dense materials is detachably mounted in the aperture 32. The bin 44 is generally wedge-shaped, the height of its sides 46, 48 tapering toward the front side 50 of the bin 44 to match the taper of the front portion 12. The back wall 52 of the bin has a plurality of holes 54 corresponding to the holes 42 in the back wall 36 of the aperture 32. Fastening means, such as bolts 56 (see FIG. 4) mount the bin 44 to the front portion 12. A nut 58 installs opposite the head of each bolt 56 and washers 60, 62 are interposed therebetween as shown in FIG. 7. An elongated wood reinforcing strip 64 extends between the washers 60 and the back wall 36 of the aperture 32 in the front portion 12.

Clay, dirt, or a similar soil mixture 66 can be placed in the bin 44 (See FIG. 4). Not only does this clay 66 provide a surface for the pitcher to stride upon during the pitching motion, it also provides sufficient weight to securely anchor the portable pitching mound 10 to the playing field. Thus, the pitching mound 10 is anchored without the use of separate anchor means which could damage the field in outdoor applications or the floor in indoor applications. As best seen in FIG. 4, the toe-receiving bin 24 can also be filled with clay 66.

The bottom 68 of the bin 44 includes a plurality of drain holes 70 therein, which permit the escape of any excess moisture that might be present in the clay. In the preferred embodiment, the holes 70 are approximately ¼" in diameter and are covered with a mesh screen (not shown) to impede the escape of the clay. When the pitching mound 10 is used outdoors, the holes 70 can drain excess moisture from the bin 44 if it rains.

The bottom 68 of the bin 44 also includes at least one horizontally elongated cavity therein for receiving a lifting member. Preferably, the cavity comprises a pair of horizontally spaced and elongated depressions 72, 74 in the bottom 68 of the bin 44. The depressions 72, 74 are adapted to slidingly receive the forks of a forklift. In order to better mate with the forks of the forklift, the depressions 72, 74 taper smaller in depth as they extend away from the back 52 of the bin 44. For the same reason, the depressions 72, 74 also taper inwardly in width. It will also be noted that the depressions 72, 74 are integrally formed in the bottom 68 of the bin 44 and therefore result in a central recessed area 76 between them when viewed from the top of the bin.

Figure 2:
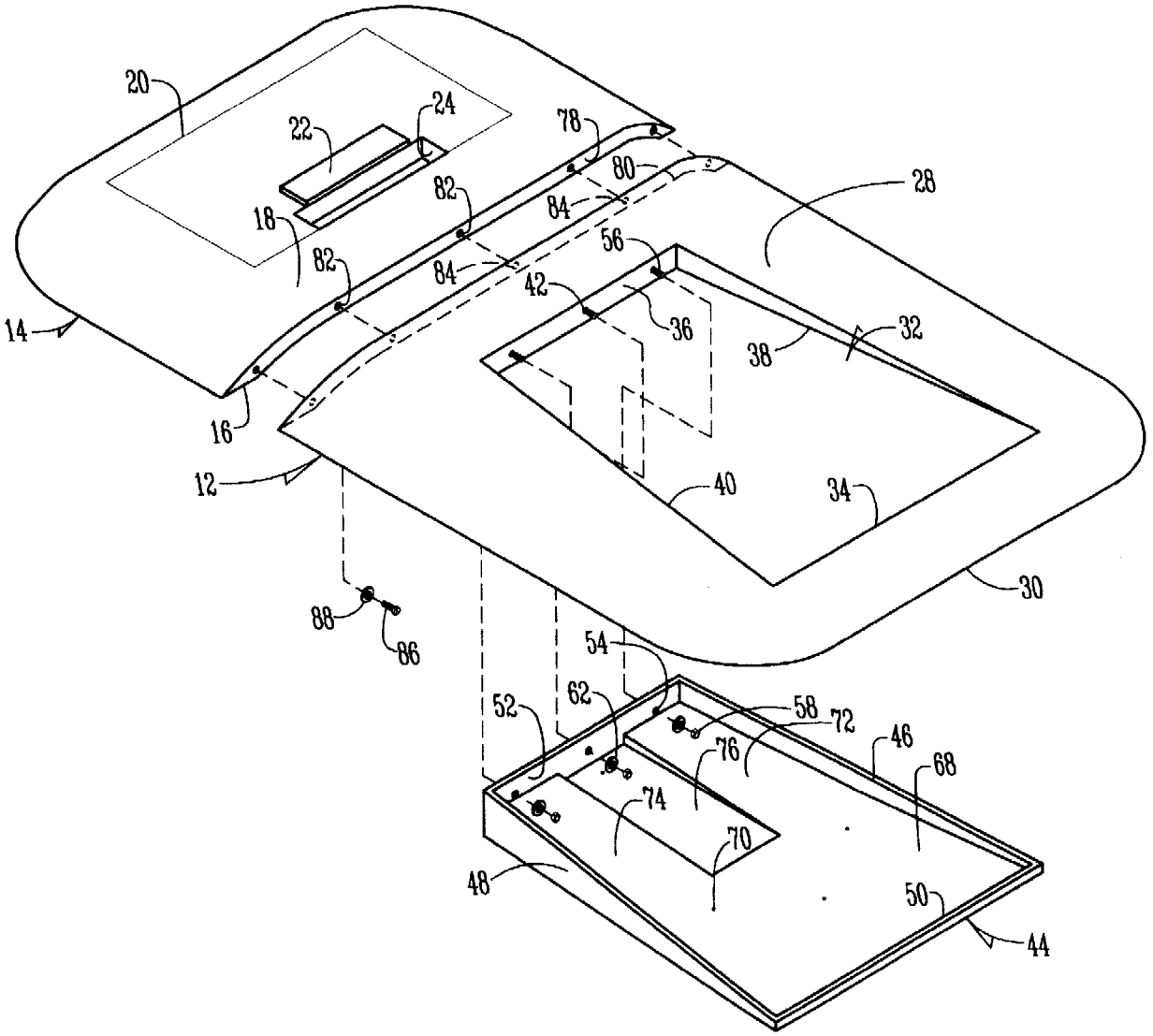
FIG. 2 is an exploded assembly view of the pitching mound of FIG. 1.
Figure 6:
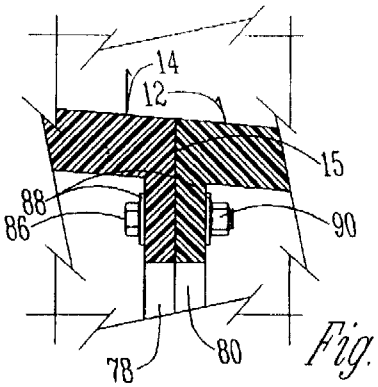
FIG. 6 is an enlarged cross-sectional view of the area 6—6 in FIG. 4.

Referring to FIGS. 2, 4 and 6, the front and rear portions 12, 14 of the portable pitching mound 10 are joined together or secured to each other along a seam 15. Preferably, the rear portion 14 has a generally vertical front edge 78 which mates with a generally vertical rear edge 80 of the front portion 12. Holes 82 extend through the front edge 78 of the rear portion 14 and are spaced apart along the transverse seam 15. A corresponding number of holes 84 through the rear edge 80 of the front portion 12 are registerable with the holes 82. Conventional fastening means, such as bolts 86, washers 88 and nuts 90 are used to secure the front and rear portions 12, 14 together along the transverse seam 15.

Figure 3:
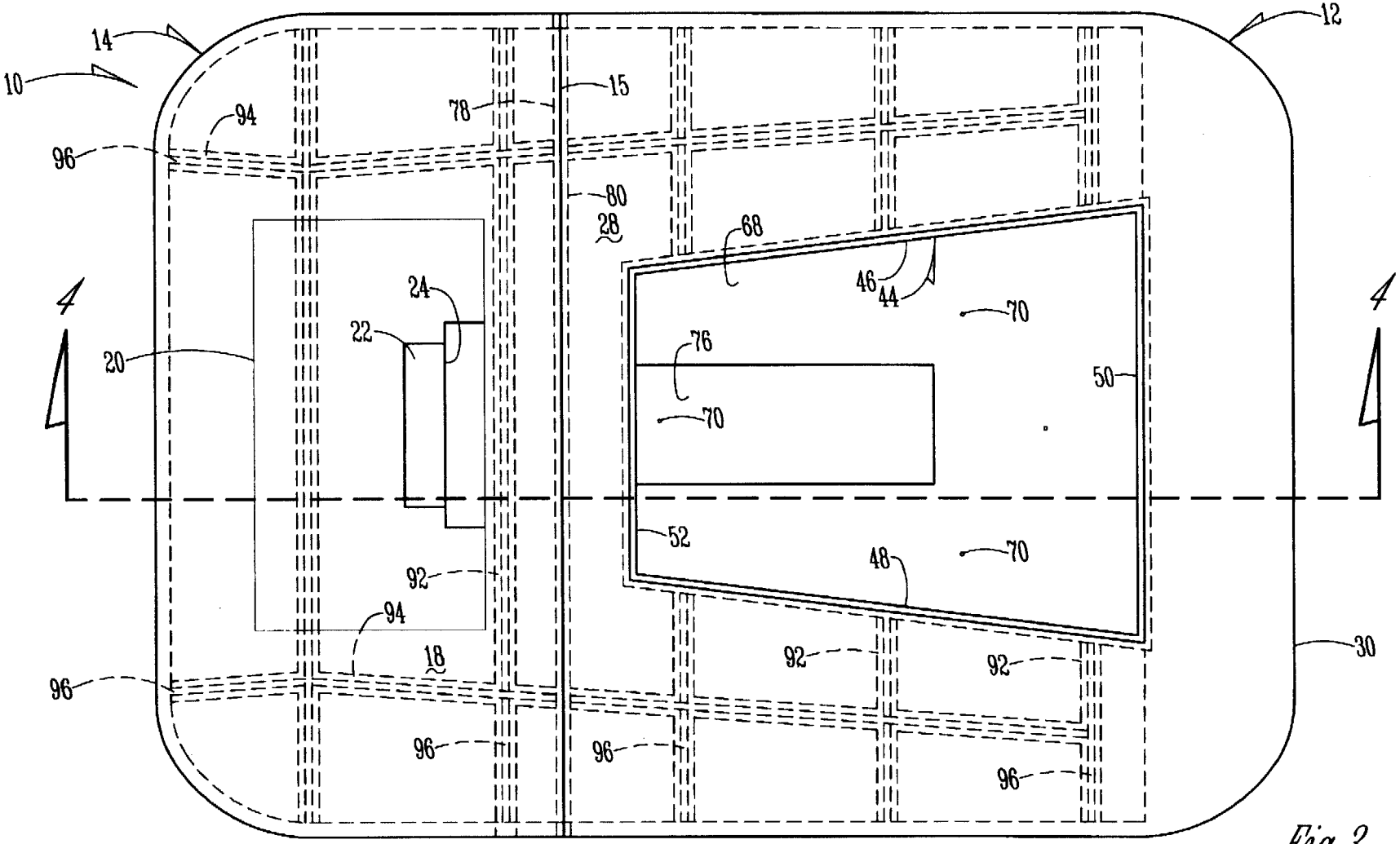
FIG. 3 is a top view of the pitching mound of FIG. 1.
Figure 5:
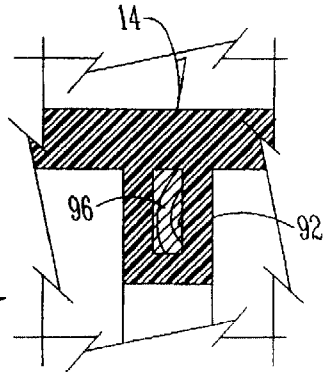
FIG. 5 is an enlarged cross-sectional view taken in the area of 5—5 of FIG. 4.

As shown by the dashed lines in FIG. 3, the portable pitching mound 10 is preferably constructed as a pair of adjoining substantially hollow shells. Bracing ribs 92, 94 extend in a criss-cross pattern across the interior of the shell. Preferably, the front and rear portions 12, 14 of the pitching mound 10 are constructed of a lightweight material, such as Fiberglas. However, as best seen in FIGS. 4 and 5, wooden reinforcing bars 96 are embedded in each of the bracing ribs 92, 94 for additional strength and structural rigidity.

In use, the portable pitching mound 10 can be transported to the site in a fully or partially disassembled state. The front and rear portions 12, 14 can be detached from one another and the bin 44 can be removed from the front portion 12 by removing the appropriate fasteners. In one embodiment, the component parts 12, 14, and 44 are reassembled after they arrive on the site. This generally involves flipping the front and rear portions 12, 14 on their sides or tops to install the necessary fasteners. The unfilled, assembled mound is moved to its desired location and carefully laid on the ground, floor, or another supporting surface as shown in FIG. 1. The grounds crew then fills the bins 44, 24 with approximately 400–800 pounds of clay or a similar soil mixture.

To remove the portable pitching mound, workers dig into the clay 66 in the bin 44 so as to expose the nuts 58. The nuts 58 and washers 62 are removed from the bolts 56 holding the bin 44 in the aperture. Pushing the bolts 56 rearwardly out the holes 42 releases the front portion 12 (and therefore the rear portion 14, too) from the bin 44 loaded with clay. One or more workers can then lift the body member 98, comprising from and rear portions 12, 14 attached together, and prepare it for transport, storage, or further disassembly. Removal of the body member allows the forks of a forklift to be inserted into the depressions 72, 74 of the bin 44.

The forklift may dump the bin 44 in a remote location or keep it loaded with clay. Then the bin 44 is placed in the transport vehicle or a suitable storage location. If the clay 66 remains in the bin 44, it must be dumped prior to the next installation of the mound 10 in order to utilize the procedure described above. Otherwise, a full bin installation procedure must be utilized.

The bin 44 filled with clay 66 is placed in the desired mound location by the forklift. This is possible because the distance between the pitching rubber 22 and the forward edge of the back wall 36 of the aperture 32 (against which the bin 44 rests) is a known dimension. Preferably, the toe-receiving bin 24 in the rear portion 14 has already been packed with clay 66, but this step can also be done later.

Next, the front and rear portions 12, 14 are joined along the transverse seam 15 and fastened to each other. The bolts 56 (with washers 60 thereon) for mounting the bin 44 are installed through the reinforcing strip 64. The strip 64 is then placed against the back wall 52 of the aperture 32 so that the bolts 56 protrude into the aperture 32 through the holes 42.

Then the convex body member 98 comprising the front and rear portions 12, 14 fastened together is carefully laid over the bin 44 so that the bolts 56 extend through the holes 54 and the back wall 52 of the bin 44. The clay 66 around the holes 54 can be temporarily removed so as to facilitate this process. One then installs washers 62 and nuts 58 on each respective bolt 56 and tightens them down. Clay is repacked around the protruding bolts 56 to substantially complete the assembly of the portable pitching mound 10 of the present invention.

The portable pitching mound 10 is anchored and held in place by the weight of the clay 66 in the bin 44. Therefore, the mound 10 becomes substantially fixed in position on the field without separate anchoring means. The mound 10 will not be dislodged under normal weather conditions or by any forces the pitcher might manually impose on it.

The portable pitching mound 10 is useful in both indoor and outdoor applications because it provides securely anchored, portable, and realistic clay pitching surfaces on a mound. One is able to build a clay pitching mound almost anywhere without disrupting the surrounding area. The mound 10 easily disassembles for storage or transport.

Therefore, it can be seen that the present invention at least accomplishes its stated objects.

What is claimed is:

1. A portable pitching mount comprising:

a generally convex body member including front and rear portions detachably secured along a seam;

the rear portion having a bottom surface, a top surface, and a peripheral edge extending between the tip and bottom surfaces;

the front portion being detachably secured to the rear portion along a portion of the peripheral edge, the front portion having a top surface with a hollow therein for receiving a dense soil mixture; and the hollow comprising an aperture in the top surface of the front portion and a removable bin being detachably mounted therein for receiving the dense soil mixture.

2. The pitching mound of claim 1 wherein the bin has a plurality of drain holes therein.

3. The pitching mound of claim 1 wherein the bin includes a horizontally elongated cavity therein for receiving a lifting member.

4. The pitching mound of claim 3 wherein the cavity comprises a pair of horizontally spaced and elongated depressions in the bottom of the bin, the depressions being adapted to receive the forks of a forklift.

5. The pitching mound of claim 1 wherein the removable bin has a bottom, a plurality of sides, and an open top.

6. The pitching mound of claim 5 wherein the sides of the bin include a front side, a rear side generally opposite the front side, and two generally opposing connecting sides extending between the front side and the rear side.

7. The pitching mound of claim 5 wherein the front portion of the body member has a bottom surface and the bottom of the bin is coplanar with the bottom surface of the front portion of the body member.

8. A portable pitching mound comprising:

a generally convex body member including detachably fastenable front and rear portions joined along a seam;

the rear portion having a bottom surface, a top surface, and a peripheral edge extending between the top and bottom surfaces, said rear portion further having an elongated pitcher's rubber mounted thereon;

the front portion having a top surface with an aperture therein; and a bin for receiving a dense soil mixture, the bin being detachably mounted in the aperture.

9. The pitching mound of claim 8 wherein the body member is oblong and the front and rear portions of the body member are detachably secured along a straight generally transverse seam.

10. The pitching mound of claim 8 wherein the aperture is generally registered with a pitching rubber mounted on the rear portion.

11. The pitching mound of claim 8 wherein the front portion of the body member has front and rear peripheral edges and the aperture is spaced inwardly from the front and rear peripheral edges of the front portion of the body member.

12. The pitching mound of claim 8 wherein the pitching rubber having a longitudinal axis extending parallel to the seam between the front and rear portions.

* * * * *